United States Patent [19]

Casada

[11] Patent Number: 4,653,608

[45] Date of Patent: Mar. 31, 1987

[54] EXTENSION LADDER CADDY

[76] Inventor: Edwin I. Casada, 271 Salisbury Sq. #103, Louisville, Ky. 40207

[21] Appl. No.: 796,972

[22] Filed: Feb. 3, 1986

[51] Int. Cl.[4] ..... E06C 7/14

[52] U.S. Cl. ..... 182/121; 248/238

[58] Field of Search ..... 182/120, 121, 122, 129; 248/238

[56] References Cited

U.S. PATENT DOCUMENTS 2,801,886 8/1957 Peterson ..... 182/121

4,401,187 8/1983 Van Patten ..... 182/121

*Primary Examiner*—Reinaldo P. Machado

[57] ABSTRACT

An extension ladder workshelf apparatus for supplying a work area on extension ladders. Apparatus is attached by hooks which allows apparatus to be attached at any desired height.

1 Claim, 4 Drawing Figures

Figure 3:
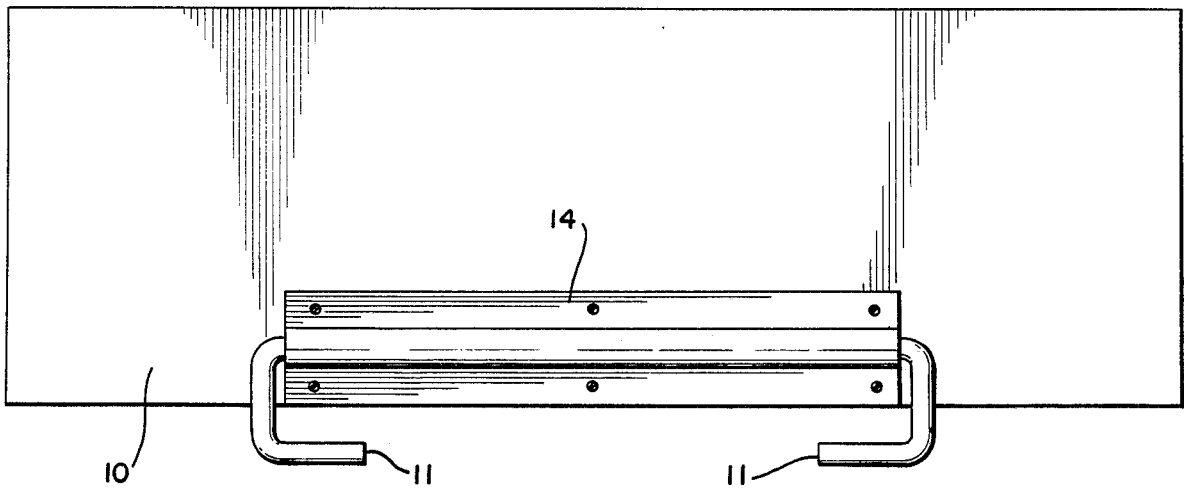
Figure 4:
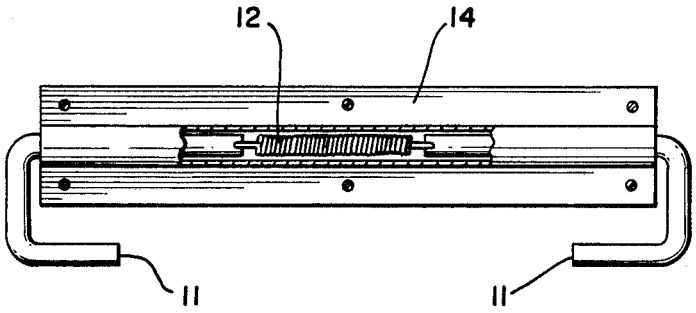

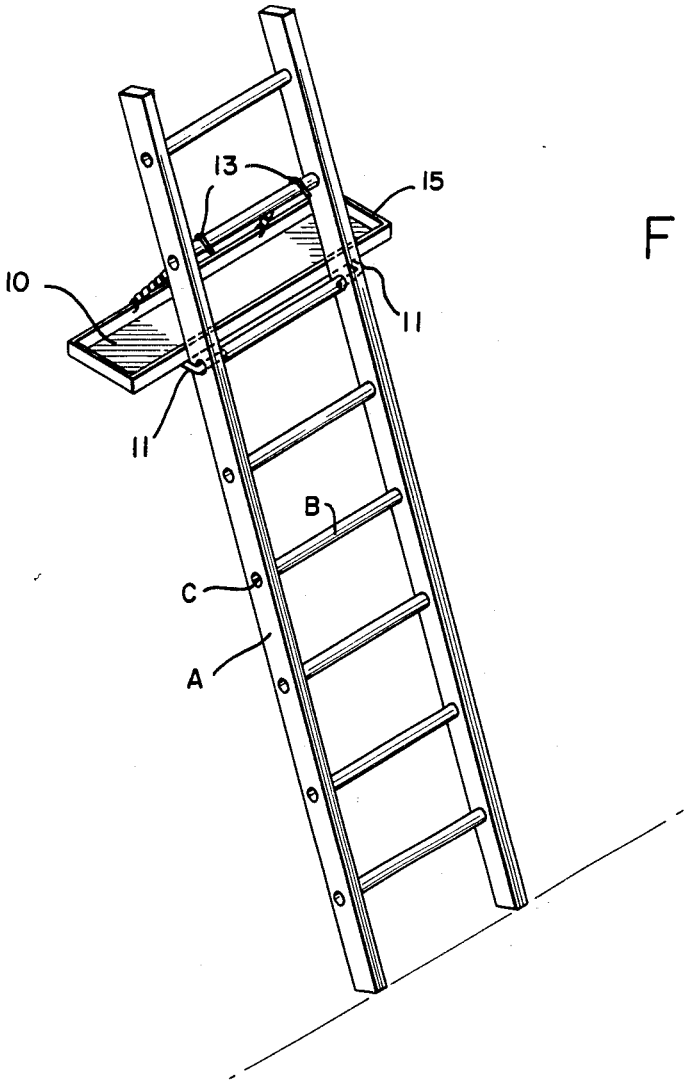
FIG. 1
FIG. 2
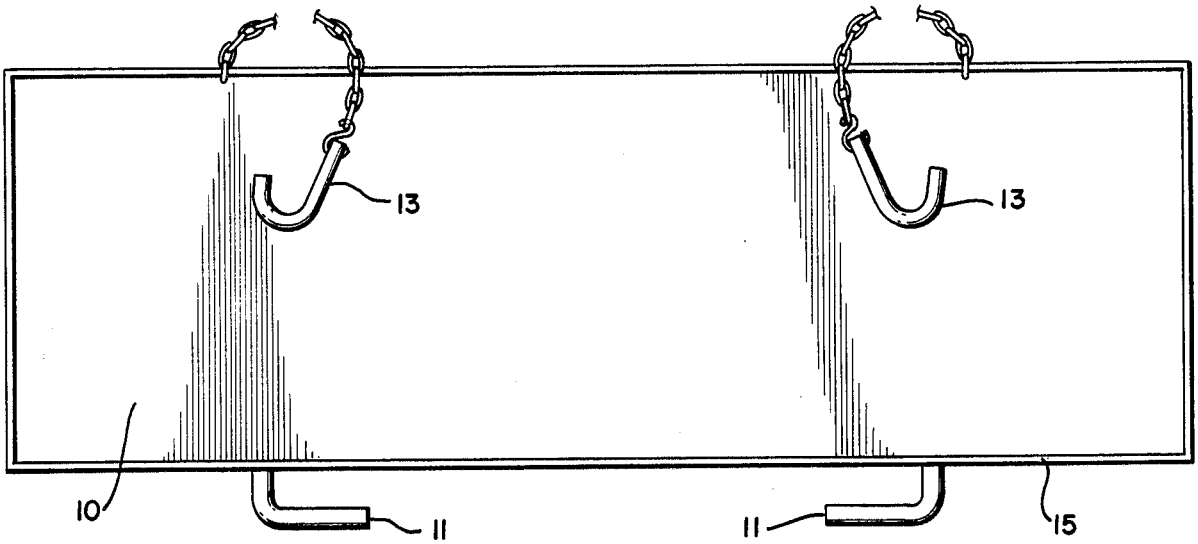

EXTENSION LADDER CADDY

This invention relates to extension ladders and more particularly to a work shelf for all extension ladders with side rails having holes where rungs are attached.

This invention provides a large work shelf for holding tools, paint buckets, caulking guns, etc. Made of light weight materials it is easy to attach at any height on the extension ladder. Ladder can also be moved with "Ladder Caddy" attached.

The principal object of this invention is to provide a large work shelf from which a worker can work from either the left or right side of the ladder with ease.

Other objects are the apparent ease in which the invention is attached and ready for use. Very light in weight but very strong. Attractive in structure and cost to the consumer. This invention can be used on all size extension ladders. The "Ladder Caddy" can be unhooked quickly and easily when not in use.

In a preferred embodiment of my invention, I provided an extension ladder work shelf comprising of two hooks with inward spring tension, for hooking into holes on the side of both ladder rails. They also allow the back of the work shelf to pivot upward. Two chain hooks attached to the back of work shelf are then hooked on the ladder rung, one rung above where spring hooks were hooked. With the extension ladder at the proper angle, work shelf will be level and ready for use.

In the foregoing general description I have set out certain objects, purposes and advantages of my invention. Other objects, purposes and advantages of the invention will be apparent from the following description and the accompanying drawing in which:

FIG. #1 is an orthographic view of an extension ladder with ladder caddy attached for use.

FIG. #2 is an orthographic view of the top work area of the ladder caddy.

FIG. #3 is orthographic view of the bottom side of the work area showing spring hook attachment.

FIG. #4 is an isometric view showing spring hook assembly.

Referring to the drawing, I have illustrated a standard aluminum extension ladder having side ladder rails (A) with rungs (B) used for steps and having holes (C) where they are attached to ladder rails (A). The ladder rails (A) and rungs (B) are formed of extruded metal.

The extension ladder caddy has two spring hooks (11) which are hooked into holes (C). To support the front of the work shelf (10). Work shelf (10) is then pivoted up at the rear so two chain hooks (13) can be hooked to ladder rung (B). Work shelf (10) is provided with a raised flange (15) around the outside edge to prevent articles from falling off work shelf (10).

In the preferred embodiment, as best shown in FIG. #4, the spring hooks (11) are attached to the bottom of work shelf (10) by a cover plate (14). Spring hooks (11) are connected by a tension spring (12) to supply inward pressure.

The extension ladder caddy is used in the following manner. The extension ladder is raised and set at the proper angle. Extension ladder caddy can then be hooked at the desired height by stretching the spring hooks (11) apart, they are then hooked into the holes (C) on the back side of ladder rails (A). Work shelf (10) is pivoted upward at the rear, so chain hooks (13) can be hooked to the ladder rung (B) above the rung (B) where spring hooks (11) were hooked. Ladder caddy now level and ready for use. Reverse this procedure to unhook the ladder caddy.

The embodiment of the invention in which an exclusive property or privilege is claimed are defined as follows:

1. In combination with an extension ladder comprising of two side rails with openings where rungs are attached, a work tray having a front end and a rear end attachment means comprising a channel attached to the front bottom of said tray from which two separate hooks, connected by a spring are housed and allowed to slide in and out in opposite directions to engage a pair of the rung openings in said ladder rails, chain hook means attached to the rear end of tray section and having hook portions extending downwardly and adapted to engage a ladder rung located above said pair of rung opening when work tray is in operative position.

* * * * *